United States Patent [19]

Valle et al.

[11] Patent Number: 4,531,850

[45] Date of Patent: Jul. 30, 1985

[54] LINE SPACING DEVICE FOR PRINTING MACHINES

[75] Inventors: Franco Valle; Pietro Musso, both of Ivrea, Italy

[73] Assignee: Ing. C. Olivetti & C., S.p.A., Ivrea, Italy

[21] Appl. No.: 623,523

[22] Filed: Jun. 21, 1984

Related U.S. Application Data

[63] Continuation of Ser. No. 518,976, Aug. 2, 1983, abandoned, which is a continuation of Ser. No. 252,580, Apr. 9, 1981.

[30] Foreign Application Priority Data

Apr. 15, 1980 [IT] Italy ..... 67580 A/80

[51] Int. Cl.[3] ..... B41J 19/14; B41J 19/80

[52] U.S. Cl. ..... 400/551; 400/568; 400/572

[58] Field of Search ..... 400/551, 568, 569, 570, 400/572, 573, 573.1, 575; 178/42, 25

[56] References Cited

U.S. PATENT DOCUMENTS

| | | | |
|---|---|---|---|
| 1,345,093 | 6/1920 | Kurowski | 400/573 |
| 2,763,357 | 9/1956 | Madsen | 400/570 X |
| 2,843,667 | 7/1958 | Slayton | 178/42 X |
| 3,048,253 | 8/1962 | Oldenburg et al. | 400/569 X |
| 3,438,477 | 4/1969 | Foersterling | 400/551 |
| 3,618,738 | 11/1971 | Boyatt et al. | 400/551 |
| 3,644,812 | 2/1972 | Bitto et al. | 400/902 X |
| 4,037,705 | 7/1977 | Martin et al. | 400/902 X |
| 4,143,981 | 3/1979 | Hansen et al. | 101/233 X |
| 4,195,940 | 4/1980 | Rekewitz | 400/551 X |

OTHER PUBLICATIONS

IBM Technical Disclosure Bulletin, "Line Feed Mechanism", vol. 9, No. 11, Apr. 1967, pp. 1622–1623, article by Robison.

*Primary Examiner*—Edgar S. Burr
*Assistant Examiner*—Charles A. Pearson
*Attorney, Agent, or Firm*—Banner, Birch, McKie & Beckett

[57] ABSTRACT

A line spacing device for printing machines comprises an electric motor arranged to rotate selectively in a clockwise direction and anticlockwise direction and a control disc carrying a pawl on an eccentric. The tooth of the pawl describes a closed trajectory engaging in the teeth of a wheel and of a sense the same as the rotation of the disc, whereby a paper support platen is rotated by one increment in the opposite sense. A central control unit controls the clockwise and anticlockwise rotations of the electric motor. A cam disengages a detent pin from the wheel so that the motor is only lightly loaded when actuating the platen.

18 Claims, 4 Drawing Figures

LINE SPACING DEVICE FOR PRINTING MACHINES

This application is a continuation of application Ser. No. 518,976, filed Aug. 2, 1983, now abandoned, which is a continuation of Ser. No. 252,580, filed Apr. 9, 1981.

BACKGROUND OF THE INVENTION

This invention relates to a line spacing device for printing machines, in particular of the electronically controlled type. In a known device of this type, a stepping motor is connected to a paper support platen in order to operate it bidirectionally. This technique is costly.

In other known devices, the spacing between lines is either controlled by a pawl connected to a clutch operated directly by the typewriter motor, or controlled by the armature of an electromagnet driven with reciprocating motion. Besides being costly, these latter techniques do not allow bidirectional movement of the platen.

SUMMARY OF THE INVENTION

One object of the present invention is therefore to provide a line spacing device which is simple, reliable, rapid, of low cost and very easy to use.

The device according to the present invention comprises a paper support platen having a toothed wheel, a pawl arranged to cooperate with the toothed wheel for the incremental rotation of the platen, a detent device engaging the toothed wheel and maintaining the platen in the position to which it has been moved, a control member for moving the pawl selectively to effect an increment of rotation of the platen in a clockwise direction and in an anticlockwise direction, and an element actuated by the control member so as to disengage the detent device during the rotation of a platen.

BRIEF DESCRIPTION OF THE DRAWING

The invention will be described in more detail, by way of example, with reference to the accompanying drawing, in which.

DESCRIPTION OF A PREFERRED EMBODIMENT

Figure 1:
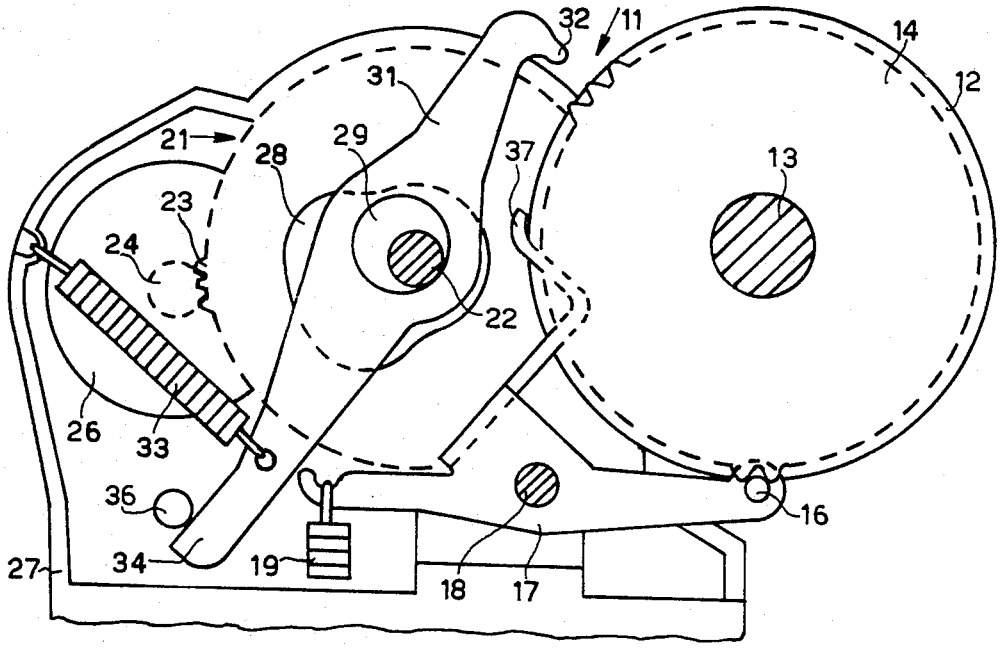
FIG. 1 is an end view of a typewriter platen and its line spacing device.

In the embodiment herein described, the line spacing device 11 (FIG. 1) is fitted to a typewriter of the electronic type comprising a normal paper support platen 12 rotatable about a shaft 13. The platen 12 comprises a toothed wheel 14 arranged to cooperate with a detent pin 16 of a positioner lever 17. The lever 17 can turn about a spindle 18 and, under the action of a spring 19 is normally held with the pin 16 between two teeth of the toothed wheel 14 to keep the platen 12 positioned in predetermined line spacing positions.

A control device 21 comprises a disc rotatable about a shaft 22 and comprises an outer ring gear 23 which is always engaged with a pinion 24 of the rotor of a direct current electric motor 26 arranged to rotate selectively in a clockwise direction and in an anticlockwise direction. The electric motor 26 is fixed in known manner to a support 27, which also supports the control disc 21 and positioner lever 17. The control disc 21 steps down the rotations of the pinion 24, and comprises a cam 28 and an eccentric 29 provided on the same side of the control disc 21.

A pawl 31 is mounted on the eccentric 29 and has a tooth 32 arranged to engage with the toothed wheel 14 during the operation of the device 11. A spring 33 normally holds the pawl 31 with a tail 34 against a fixed stop 36 on the support 27, with the tooth 32 disengaged from the toothed wheel 14 as shown in FIG. 1. The cam 28 is arranged to cooperate with a cam follower lever arm 37 of the positioner lever 17 during the operation of the device 11.

Figure 2:
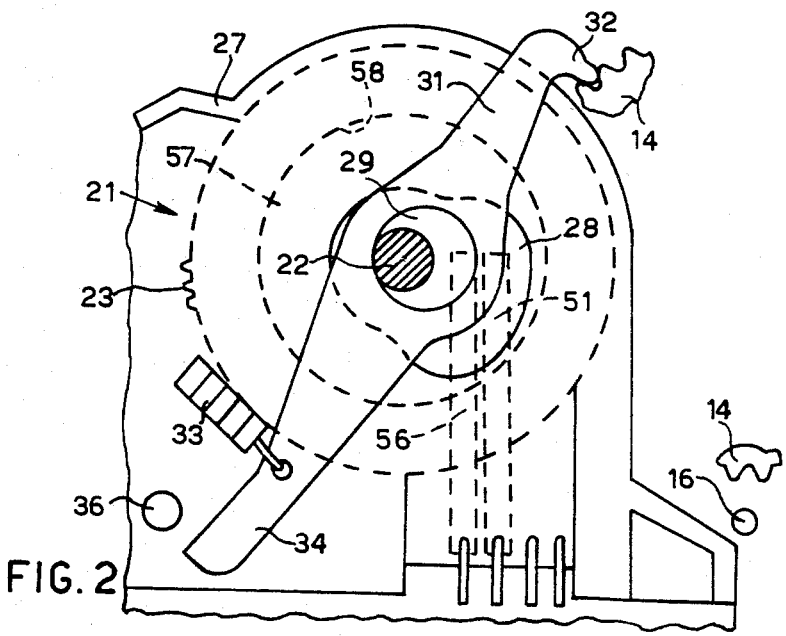
FIG. 2 is a like end view showing the device of FIG. 1 in a working position.

If the electric motor 26 causes the control disc 21 to rotate clockwise, the eccentric 29 begins to move the pawl 31 towards the platen 12 along a closed trajectory which has a part external to the teeth of the wheel 14 and a part interfering with these teeth and which disposes the tooth 32 in a space between two adjacent teeth of the toothed wheel 14. Simultaneously the cam 28, which is rigid with the eccentric 29, engages the cam follower lever arm 37 and causes the positioner lever 17 to rotate clockwise against the action of the spring 19, so disengaging the pin 16 from the wheel 14. With the tooth 32 engaged in the space between two adjacent teeth of the wheel 14, the pin 16 is disengaged and outside the trajectories of the teeth of the wheel 14, as shown in FIG. 2. As the disc 21 continues to rotate, the eccentric 29 and pawl 31 cause the wheel 14 together with the roller 12 (FIG. 1) to rotate in an anticlockwise direction. As the eccentric 29 causes the pawl 31 to follow a closed trajectory, during the rotation of the disc 21, the tooth 32 disengages from the wheel 14 and simultaneously the cam 28 enables the spring 19 to return the pin 16 into the trajectory of the teeth 14 in order to engage a further space and thus keep the platen 12 positioned. The disc 21 continues to rotate the eccentric 29 with the pawl 31 and cam 28 back to the rest position of FIG. 1.

If the electric motor 26 causes the control disc 21 to rotate in an anticlockwise direction, the eccentric 29 initially lowers the pawl 31 and then withdraws it from the platen 12, while again passing through the same closed trajectory but in the opposite sense to the preceding path. The cam 28 simultaneously engages the cam follower lever 37 and causes the positioner 17 to rotate clockwise against the action of the spring 19, to disengage the pin 16 from the wheel 14. Because of the opposite sense of movement of the tooth 32, it causes the wheel 14 and platen 12 this time to rotate clockwise. After the tooth 32 disengages from the wheel 14 and the cam 28 simultaneously allows the spring 19 to return the pin 16 to engagement with the teeth of the wheel 14, the cycle is completed with the return to the rest position of the eccentric 29, the pawl 31 and the cam 28.

It is apparent that by rotating the control disc 21 in a clockwise or anticlockwise direction, the electric motor 26 causes the pawl 31, by means of the eccentric 29, to travel through part of its closed trajectory in the two directions, in interference with the wheel 14, to rotate the paper support platen 12 in an anticlockwise or clockwise direction. Furthermore, the retraction of the positioner 17 from the toothed wheel 14 means that the electric motor 26 is only lightly electrical loaded during the clockwise and anticlockwise rotations which control the line spacing of the roller 12.

Figure 3:
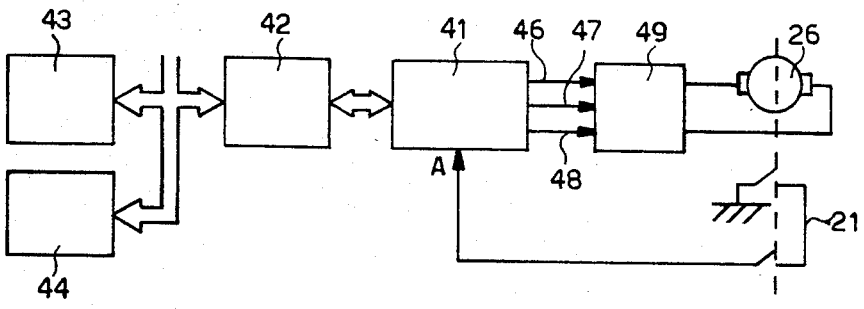
FIG. 3 is a logic block diagram of a control unit for the device of FIGS. 1 and 2.
Figure 4:
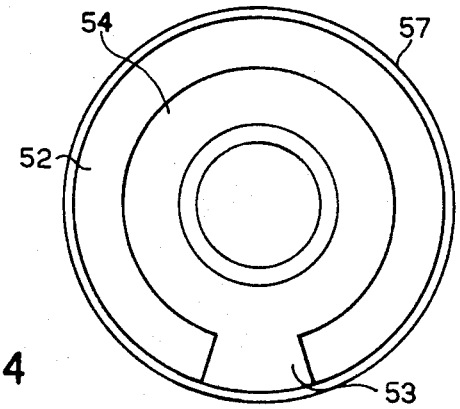
FIG. 4 is a partial plan view of a detail of FIG. 2 to an enlarged scale.

The line spacing device heretofore described may be fitted to a typewriter of the type described in the published British patent application No. 2 031 626, comprising an input and output unit 41 (FIG. 3) controlled by a central unit 42 connected to memories 43 and to a keyboard 44. The input and output unit 41 controls the clockwise and anticlockwise rotations and the stoppage of the electric motor 26 by means of three lines 46, 47 and 48 and an amplifier circuit 49, and receives position information of the control disc 21 by way of a strobe signal A. This signal is generated by a brush 51 (FIG. 2) sliding on a track 52 (FIG. 4) having a part 53 connected to a common track 54 in in constant contact with a brush 56 (FIG. 2). The tracks 52 and 54 are carried by an insulating support 57 fixed in a seat 58 (FIG. 2) of the control disc 21 and disposed on the side opposite the cam 28 and eccentric 29. The control disc 21 can only stop in the reference position of $0° \pm 15°$, so that after each rotation or after a predetermined number of rotations, the motor 26 is halted in the reference position with a certain tolerance which is small enough to enable the pin 16 of the positioner 17 always to engage the correct space in the wheel 14 with the tooth 32 disengaged from the wheel 14.

We claim:

1. A line spacing device for a printing machine comprising a rotatable paper support platen (12); a toothed wheel (14) connected with said platen (12); a detent device (17) for maintaining the platen (12) in the position to which the platen (12) has been moved, including a detent lever with a detent element (16) urged by a spring (19) and engageable with the toothed wheel (14) and a cam follower lever (37) connected with said detent lever; a motive shaft (22) having a rest position and arranged to rotate selectively and cyclically in a clockwise direction and in a counterclockwise direction; means mounting an eccentric (29) and a cam (28) on said motive shaft (22); a pawl member (31) mounted on said eccentric (29) and including a tooth (32) cooperative with said toothed wheel; and means (36) defining a rest position of said pawl member causing said tooth to be disengaged from said toothed wheel; wherein said pawl member responds to the rotation of said eccentric (29) for causing said tooth to describe a trajectory having a part which interferes with said toothed wheel (14); wherein said tooth (32) travels through said part in one or the other direction in accordance with the clockwise or counterclockwise rotation of said motive shaft (22) for the incremental bidirectional rotation of the platen (12); wherein said detent element (16) is engaged with said toothed wheel (14) and said tooth (32) is disengaged from said toothed wheel (14) in the rest position of said motive shaft (22); and wherein said cam (28) engages said cam follower lever (37) during the rotation of the motive shaft (22) for releasing said detent element (16) from the toothed wheel (14) before the engagement of the tooth (32) of said pawl member (31) with the toothed wheel (14).

2. A line spacing device according to claim 1, further comprising a gear (23) fixed to said motive shaft (22) and a bidirectional rotatable electric motor (26) having a pinion (24) engaged with said gear (23) for causing the bidirectional rotation of said motive shaft.

3. A bidirectional line spacing device for printing machines comprising a paper support platen having a toothed wheel synchronous with said platen and provided with peripheral teeth; a pawl including a tooth engageable with the toothed wheel for incrementally rotating the paper support platen; an eccentric device connected with said pawl; a motor having a rotor rotatably connected with said eccentric device for moving the tooth of the pawl according to a predetermined trajectory, wherein said trajectory has one part which interferes with the teeth of the toothed wheel for the rotation of the platen and another part external to the toothed wheel and inoperative on said platen; an indicator which defines a first and a second angular zone of the eccentric device, wherein the positions of the eccentric device within said first angular zone are associated with positions of the tooth disengaged from the toothed wheel and included in said other part of the trajectory and wherein the positions of the eccentric device within said second angular zone are associated with positions of the tooth included in said one part of the trajectory; a circuit controlled by said indicator which energizes the motor to cause the rotor to selectively rotate the eccentric device in the two directions of rotation, according to a substantially full rotation starting from a starting position within said first angular zone, through said second angular zone and until a final position within the first angular zone of the indicator is reached, in order to cause the tooth to travel, in one or the other direction, through said one part of the trajectory which interferes with the toothed wheel thereby to cause corresponding incremental rotations of the platen in the two directions; and a positioning detent which solely and exactly positions and arrests the platen in given line spacing positions associated with the reached line spacing position corresponding to the disengagement of the pawl tooth from the toothed wheel and irrespectively of the direction of rotation and the starting and final position of the eccentric device, wherein said positioning detent comprises a lever mounted on pivot means including a detent element and operated by a spring and wherein said spring causes the detent element to engage the teeth of said toothed wheel for positioning and arresting said platen.

4. A device as claimed in claim 3, wherein the motor is a direct current motor.

5. A device as claimed in claim 3, wherein said indicator comprises a synchronization disc synchronous with the eccentric device and provided in one of its angular sectors with a part associated with said predetermined angular zone, and a detector arranged to detect said part.

6. A device as claimed in claim 5, wherein the disc comprises an insulating support, said part is a conducting track deposited on the insulating support, and the detector is a brush arranged to contact the conducting track.

7. A device as claimed in claim 3, wherein the part which interferes with the toothed wheel is calculated to give an elementary line spacing of the platen, and wherein the circuit determines the size of the line spacing by means of a repetition of the cyclic rotation of the eccentric device.

8. A device as claimed in claim 3, comprising a spring and a fixed stop and the motor having a pinion, and wherein said pawl is retained at rest by the spring against the fixed stop when in its position of disengagement from the toothed wheel, and wherein the eccentric device comprises a rotatable part and a step-down gear engaged with the pinion of the motor.

9. A device as claimed in claim 3, further comprising a control member positioned by the eccentric device, which releases the positioning detent in concordance with the engagement of the tooth with the toothed wheel.

10. A line spacing device according to claim 3, wherein said rotor is connected with said eccentric device through a gear fixed to said eccentric device and a pinion fixed to said rotor and engaging with said gear.

11. A bidirectional line spacing device for printing machines comprising a paper support platen having a toothed wheel; a pawl including a tooth for incrementally rotating the paper support platen; and eccentric device connected with said pawl; a motor having a rotor rotatably connected with said eccentric device for moving the tooth of the pawl according to a predetermined trajectory, wherein said trajectory has a part which interferes with the toothed wheel and another part external to the toothed wheel; an indicator which defines a first angular zone of the eccentric device which is associated with positions of the tooth disengaged from the toothed wheel; a circuit controlled by said indicator which energizes the motor to cause the rotor to selectively rotate in the two directions of rotation, until the first angular zone of the indicator is reached in order to cause the tooth to travel, in one or the other direction, through the part of the trajectory which interferes with the toothed wheel thereby to cause corresponding incremental rotations of the platen in the two directions; a positioning detent which arrests the platen in the reached line spacing position corresponding to the disengagement of the pawl tooth from the toothed wheel; and a cam synchronous with said eccentric device; wherein the positioning detent comprises a spring, a positioning element urged by said spring and engageable with the toothed wheel for maintaining the platen in the position to which the platen has been moved and a cam follower lever; and wherein said cam engages said cam follower lever during the rotation of the rotor of said motor for releasing said positioning element from the toothed wheel before the engagement of the tooth of said pawl with the toothed wheel.

12. In a line spacing device for a typewriter, comprising a paper supporting platen, a toothed wheel connected to rotate with the platen, a pawl having a tooth arranged to cooperate with the toothed wheel, a motor, an eccentric control member rotated by the motor and carrying the pawl to impose on the tooth a trajectory having a part which interferes with the toothed wheel, a position indicator associated with said eccentric control member, a positioning detent urged by a spring for arresting the platen in predetermined line spacing positions, and a cam member mounted for rotation with said eccentric control member, said cam member engaging a cam follower attached to said positioning detent to retract said detent from said toothed wheel, wherein;

the motor is of reversible type and the teeth of the toothed wheel and the tooth of the pawl have shape enabling said platen to be rotated bidirectionally in accordance with a bidirectional movement of the tooth of said pawl along its trajectory, said positioning detent comprises a lever having a detent element which cooperates with said toothed wheel under the action of said spring, and said position indicator generates a signal having a first and a second status wherein the first status of said signal corresponds to given angular positions of the eccentric control member wherein the tooth of said pawl is disengaged from the toothed wheel and wherein the second status of said signal corresponds to remaining angular positions of the eccentric control member including positions wherein the tooth of said pawl is engaged with said toothed wheel, and further comprising a circuit actuatable for selectively driving said motor in one of the two directions of rotations, for bidirectionally actuating the line spacing of said platen, wherein said circuit responds to the first status of said signal to start with the rotation of said eccentric control member from one of said given angular positions, to the switching of said signal in the second status to continue with a substantially complete rotation of the eccentric control member through the remaining angular positions, until the first status of said signal is again generated by said position indicator to stop said control member in another of said given angular positions, and wherein said spring causes said detent element to engage the teeth of said toothed wheel for exactly positioning and arresting the platen in the desired line space irrespective of the sense of rotation and the final position of said eccentric control member.

13. A device as claimed in claim 12, wherein the motor is a direct current motor.

14. A device as claimed in claim 12, wherein said position indicator comprises a synchronization member synchronous with the eccentric control member and provided in one of its angular sectors with a part corresponding to the given angular positions, and a detector arranged to detect the said part corresponding to the given angular positions.

15. A device as claimed in claim 12, wherein the part of trajectory of the tooth which interferes with the toothed wheel is calculated to give an elementary line spacing of the platen, and wherein said circuit determines the size of the line spacing by means of a repetition of the cyclic rotation of the rotor of said motor.

16. A device as claimed in claim 12, wherein said pawl is retained at rest by a spring against a fixed stop when in its position of disengagement from the toothed wheel, and wherein the eccentric control member is rigid with a stepdown gear engaged with a pinion of the rotor of said motor.

17. A device as claimed in claim 12, wherein the lever of said positioning detent comprises a pin engageable with the toothed wheel.

18. A device as claimed in claim 17, further comprising a control member positioned by the rotor of said motor, which releases the positioning detent in concordance with the engagement of the pawl tooth with the toothed wheel.

* * * * *